US011389008B2

(12) United States Patent
Nie

(10) Patent No.: US 11,389,008 B2
(45) Date of Patent: Jul. 19, 2022

(54) FOLDABLE TENSION SPRING MATTRESS

(71) Applicant: Bo Nie, Chongqing (CN)

(72) Inventor: Bo Nie, Chongqing (CN)

( * ) Notice: Subject to any disclaimer, the term of this patent is extended or adjusted under 35 U.S.C. 154(b) by 228 days.

(21) Appl. No.: 16/634,452

(22) PCT Filed: Jul. 11, 2018

(86) PCT No.: PCT/CN2018/095296
§ 371 (c)(1),
(2) Date: Jan. 27, 2020

(87) PCT Pub. No.: WO2019/019919
PCT Pub. Date: Jan. 31, 2019

(65) Prior Publication Data

US 2021/0007503 A1 Jan. 14, 2021

(30) Foreign Application Priority Data

Jul. 26, 2017 (CN) ..... 201710618513.2

(51) Int. Cl.
*A47C 27/07* (2006.01)
*A47C 27/045* (2006.01)

(52) U.S. Cl.
CPC ..... *A47C 27/07* (2013.01); *A47C 27/0453* (2013.01)

(58) Field of Classification Search
CPC ..... A47C 27/045; A47C 27/06; A47C 27/07
See application file for complete search history.

(56) References Cited

U.S. PATENT DOCUMENTS 614,987 A * 11/1898 Ryan ..... A47C 23/30 5/252
1,893,170 A * 1/1933 Hilton ..... A47C 27/0456 5/252

(Continued)

FOREIGN PATENT DOCUMENTS

CN 104146531 A 11/2014
CN 107232867 A 10/2017
DE 202009008808 U1 * 12/2009 ..... A47C 27/0456

OTHER PUBLICATIONS

DE-202009008808-U1 translation (Year: 2009).*
Sep. 3, 2018 International Search Report issued in International Patent Application No. PCT/CN2018/095296.

*Primary Examiner* — Jacob J Cigna
*Assistant Examiner* — Michael W Hotchkiss
(74) *Attorney, Agent, or Firm* — Oliff PLC

(57) ABSTRACT

A foldable tension spring mattress, wherein a vertical pressure is converted into a tension by means of a wrapping blanket; the tension acts on the periphery of a spring net and is converted into a pulling force acting on coil springs and penetrating springs; and then the pulling force is uniformly dispersed to each of the coil springs, so that the local overstressing of the coil springs and the penetrating springs is avoided, thereby preventing the spring net and the penetrating springs from being arched and sunken. As a result, the mattress may keep good elasticity all the time, which further increases the comfort level of the spring mattress. The present solution may alleviate the plastic deformation of the coil springs to further increase the comfort level of the spring mattress and improve the elasticity and durability of the spring mattress.

4 Claims, 6 Drawing Sheets

(56) References Cited

U.S. PATENT DOCUMENTS 2,261,581 A * 11/1941 Gleason ..... A47C 27/06 5/267
2,291,390 A * 7/1942 Krakauer ..... A47C 27/06 5/267
3,242,505 A * 3/1966 Tyhanic ..... A47C 27/06 5/267
3,259,924 A * 7/1966 Inman ..... A47C 27/07 5/655.7
3,456,271 A * 7/1969 Janapol ..... A47C 27/07 5/722
3,716,874 A * 2/1973 Thomas, Jr. ..... A47C 23/05 5/256
3,911,511 A * 10/1975 Higgins ..... A47C 27/065 5/255
3,995,337 A * 12/1976 Gershaw ..... A47C 27/062 5/936
5,485,639 A * 1/1996 Cavazos ..... A47C 27/07 5/259.1
5,669,087 A * 9/1997 Wells ..... A47C 27/062 5/267
7,578,016 B1 * 8/2009 McCraw ..... A47C 27/06 5/269
7,850,153 B2 * 12/2010 Bock ..... A47C 27/064 5/247
2005/0235426 A1 * 10/2005 Colman ..... A47C 27/07 5/716
2007/0022532 A1 * 2/2007 Ahn ..... A47C 27/04 5/430
2007/0294824 A1 * 12/2007 Huang ..... A47C 27/066 5/247
2011/0302721 A1 * 12/2011 Khambete ..... A47C 27/06 29/428
2015/0150384 A1 * 6/2015 Khambete ..... A47C 27/06 442/50
2018/0249842 A1 * 9/2018 Grothaus ..... A47C 27/07

* cited by examiner

FOLDABLE TENSION SPRING MATTRESS

TECHNICAL FIELD

The present invention belongs to the field of mattresses, and particularly, relates to a foldable tension spring mattress.

BACKGROUND

Compared with mattresses made of other materials, spring mattresses are sturdier and more durable. They are very strong in air permeability and impact resistance, and have reasonable softness and support for a human body, so that a user may not feel uncomfortable due to stress and may easily find the most comfortable posture.

Typically, the existing spring mattress is composed of coil springs, penetrating springs, support springs with a diameter of 32 mm, clip chips, and upper and lower enclosure frames having a diameter of 50 mm. FIG. 1 is a side view of a spring mattress. In FIG. 1, the upper enclosure frame is fixedly connected to the upper ends of the coil springs by the clip chips; the lower enclosure frame is fixedly connected to the lower ends of the coil springs through the clip chips; and two ends of each of the support springs are fixedly connected to the upper and lower enclosure frames, respectively. When a user sits on the upper enclosure frame, as shown in FIG. 2, the support springs are compressed, and meanwhile, the upper enclosure frame pulls the coil springs sideways through the clip chips. Here, the upper ends of the coil springs undergo a sideway pulling force rather than a vertical pressure, and the coil springs are prone to plastic deformation under the action of the sideway pulling force, which may cause damage to the coil springs in the long run and weaken the supporting effect of the coil springs. After long-term or repeated compression, the support springs may also deform plastically, which may further keep the coil springs, penetrating springs, support springs and clip chips, all of which are connected to the upper and lower enclosure frames, in a stretched state for a long time, further damaging the coil springs and the penetrating springs.

FIG. 3 is a schematic top view showing a manner of connecting coil springs and penetrating springs in an existing spring mattress, where the coil springs in a first row and the coil springs in a second row are connected in series through a first penetrating spring 1; and the coil springs in the second row and the coil springs in a third row are connected in series through a second penetrating spring 2. When the first and second penetrating springs 1 and 2 connect the coil springs in series, left ends of the first and second penetrating springs 1 and 2 penetrate into the coil springs in the second row at first and then penetrate out from the coil springs in the first and third rows respectively; the contact portions for penetrating-in of the first and second penetrating springs 1 and 2 and the coil springs are on the left sides of the coil springs in the second row; and the contact portions for penetrating-out of the first and second penetrating springs 1 and 2 and the coil springs are on the right sides of the coil springs in the first and third rows respectively. As shown in FIG. 3, when undergoing a lateral force towards the left, the coil springs in the second row are squeezed under the lateral force and then misaligned with the coil springs in the first and third rows. In this way, the recessed springs in respective columns may not be aligned evenly; and the coil springs and the penetrating springs are prone to the plastic deformation in the long run, resulting in deformation and service life reduction of the spring mattress.

SUMMARY

An object of the present invention is to provide a foldable tension spring mattress to alleviate the plastic deformation of coil springs, thereby increasing the comfort level of the spring mattress and improving the elasticity and durability of the spring mattress.

To achieve the object above, the present invention has a basic solution as follows: a foldable tension spring mattress, including a spring net, wherein the spring net includes a plurality of coil springs and a plurality of penetrating springs for connecting the coil springs in series; the coil springs are arranged in a rectangular array on the same horizontal plane; a distance H is reserved between every two adjacent columns of the coil springs; supporting rings of the coil springs in adjacent rows are mutually abutted or crossed; each of the penetrating springs has one end penetrating in from a row of the coil springs, and the other end penetrating out from an adjacent row of the coil springs, thereby forming contact portions where the penetrating springs penetrate in or out from the coil springs; each of the coil springs has a contact portion for penetrating-in and a contact portion for penetrating-out; a middle recess of each of the coil springs is provided with a coiling-spring clamp ring for clamping the coil spring, through welding; each of the coiling-spring clamp rings consists of two clamp rings that are welded in cross; each of the coiling-spring clamp rings is penetratively provided with two of the penetrating springs which are crossed, with one penetrating spring penetrating through one of the clamp rings of the coiling-spring clamp ring and being connected with the other clamp ring of the coiling-spring clamp ring in series to form two contact portions; and the foldable tension spring mattress further includes a wrapping blanket wrapping the spring net, wherein a periphery of the spring net is fixedly connected to a periphery of the wrapping blanket by an adhesive, and the wrapping blanket is a woolen blanket or chemical-fiber blanket with a gram weight of 550-600 g.

The principle of the basic solution is as follows: when a user lies on the mattress, the body weight directly acts on the wrapping blanket; the wrapping blanket disperses and converts a vertical downward pressure into a pulling force acting on the periphery of the spring net; and the coil springs at the periphery of the sprig net first undergo the pulling force and then transmit the pulling force to the penetrating springs, thereby pulling the coil springs connected in series on the penetrating springs to move. Here, for every two adjacent coil springs, connected in series by the penetrating spring, in the same column, one of the coil springs has the contact portion for penetrating-in, the other has the contact portion for penetrating-out, and both of the contact portions are at two sides of the penetrating spring to allow the two coil springs to support each other, so that the forces acting on the two coil springs cancel each other out, thereby preventing the coil springs in different rows from dislocation and ensuring the stability of the overall structure of the spring mattress. Meanwhile, the pulling force is dispersed to a plurality of coil springs and penetrating springs, and when the penetrating springs and the coil springs undergo the pulling force, the pulling force is dispersed to the coil springs connected in series on the penetrating springs, thereby alleviating the plastic deformation of the individual coil springs and the individual penetrating springs.

In addition, when the coil springs undergo the vertical downward pressure locally, the coil springs are pressed down and simultaneously, pull the penetrating springs connected with the clamp rings in series to convert the vertical pressure into the pulling force acting on the penetrating springs. Here, the penetrating springs pull all the coil springs connected with the penetrating springs through the clamp rings to evenly transmit the pulling force to all the coil springs, thereby further dispersing the vertical pressure to each of the coil springs.

The basic solution has the following advantages. 1. The vertical pressure directly acts on the wrapping blanket, so that the penetrating springs are not stressed; meanwhile, the wrapping blanket may convert the vertical pressure into the tension that uniformly acts on the periphery of the spring net; and then the tension is converted into the pulling force acting on the periphery of the spring net, so that the vertical pressure can be effectively dispersed to further reduce the vertical pressure locally acting on the coil springs and penetrating springs, thereby effectively alleviating the plastic deformation of the individual coil springs and the individual penetrating springs. Moreover, the higher the vertical pressure is, the higher the tension generated by the wrapping blanket is, and the more the pulling force converted from the pressure is, resulting in high tension resistance to prevent the spring net from deformation. 2. The manner of connecting the coil springs in series through the penetrating springs may effectively provide each coil spring with one contact portion for penetrating-in and one contact portion for penetrating-out; the contact portions for penetrating-in and the contact portions for penetrating-out are at two sides of the coil springs, allowing the contact portions of the coil springs to undergo the force when the penetrating springs undergo the pulling force. When force-receiving points are located on the two coil springs and at two sides of the penetrating springs, every two adjacent coil springs in the same column press each other to effectively prevent the coil springs from dislocation and further prevent the whole spring mattress from deformation. 3. When undergoing the vertical pressure, the woolen or chemical-fiber blanket having the gram weight of 550-600 g is not prone to deformation and may effectively convert the vertical pressure into the tension, allowing the user to quickly feel the elasticity of the spring mattress, thereby bringing comfort to the user.

In summary, the spring mattress in the present solution converts the vertical pressure into the tension by means of the wrapping blanket; the tension acts on the periphery of the spring net and is converted into the pulling force acting on the coil springs and the penetrating springs, thereby evenly dispersing the pulling force to each of the coil springs. Therefore, the local overstressing of the coil springs and the penetrating springs is avoided, and the spring net and the penetrating springs are further prevented from being arched and sunken, thereby keeping good elasticity for the mattress all the time and further increasing the comfort level for the spring mattress.

Preferred solution 1: As a preferred solution of the basic solution, each of the coil springs has a free height of 156 mm, with upper and lower ends having a diameter of 52 mm, the middle recess having a diameter of 42 mm, and a steel wire having a diameter of 1.75 mm; the number of coils of each of the coil springs 10 is not less than 6; and a steel wire of each of the penetrating springs has a diameter of 1.4 mm, and each of the penetrating springs has a coil diameter of 8.1 mm, and a coil pitch of 11 mm. With the configuration above, the middle-recessed coil springs with good stability and compact structure may withstand loads and attenuate vibration in a vertical direction; and the penetrating springs are matched with the coil springs in respective parameters, and thus may effectively connect the coil springs in series more stably.

Preferred solution 2: As a preferred solution of preferred solution 1, the foldable tension spring mattress further includes cotton felt and a plastic balancing net, wherein the plastic balancing net is in contact with the spring net; the wrapping blanket wraps the plastic balancing net; and the cotton felt wraps the wrapping blanket. With the configuration above, the cotton felt and the plastic balancing net may further reduce the vibration caused by the coil springs, and meanwhile, may provide an improved comfort level for the user.

Preferred solution 3: As a preferred solution of preferred solution 2, two ends of each of the penetrating springs are fixedly wound on the coil springs. With the configuration above, the penetrating springs may be effectively prevented from falling off from the coil springs, and the stability of the spring net may be enhanced at the same time.

DETAILED DESCRIPTION

Figure 1:
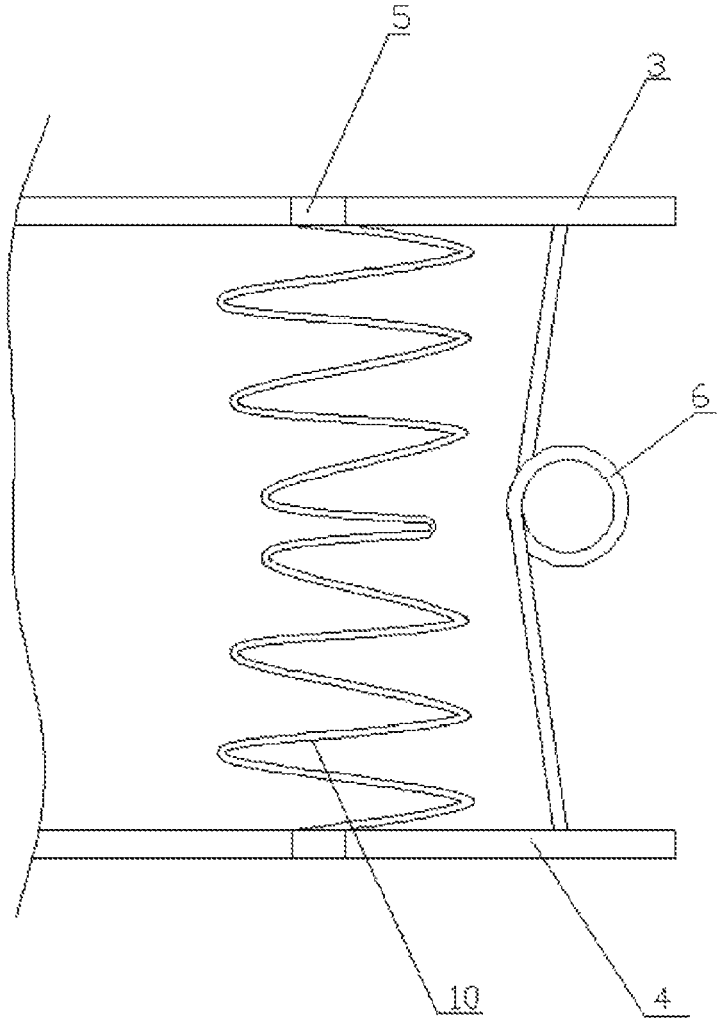
FIG. 1 is a side view of a spring mattress in the background art.
Figure 2:
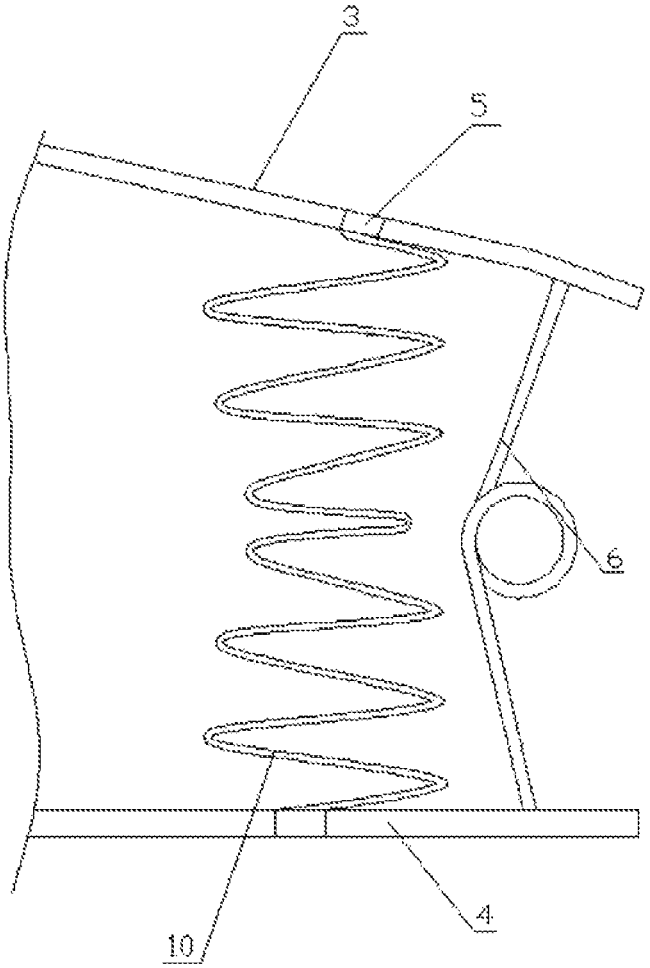
FIG. 2 is diagram showing a compressed spring mattress in the background art.
Figure 3:
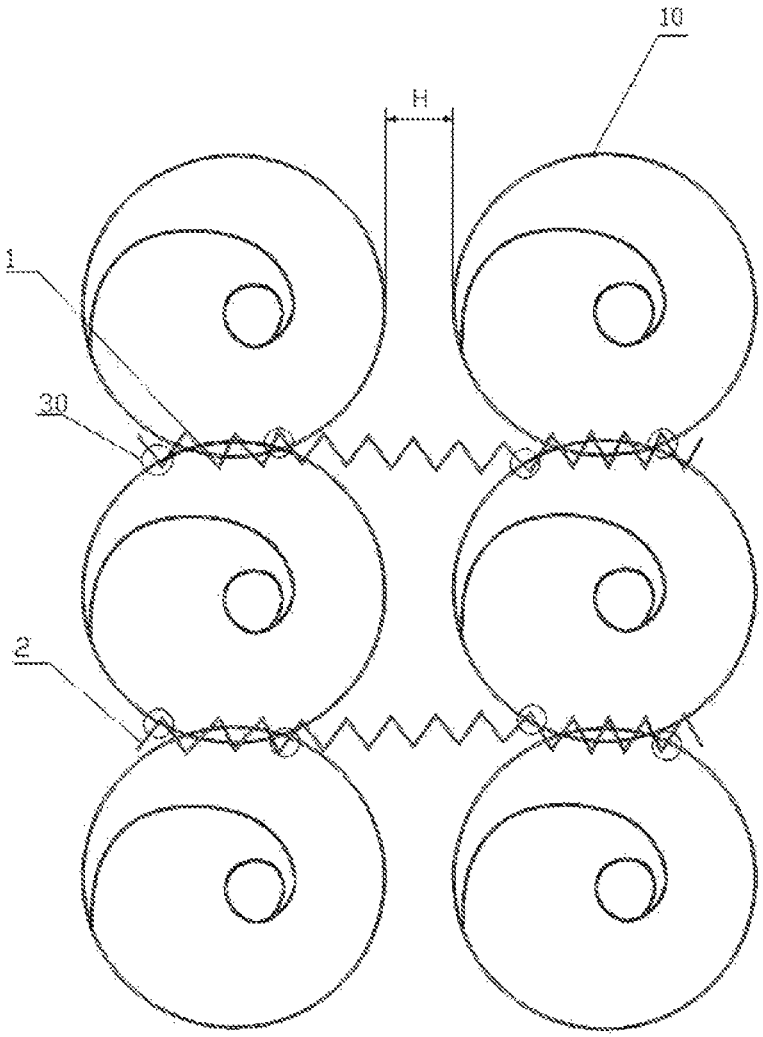
FIG. 3 is a schematic top view of a manner of assembling springs in the background art.

The present invention will be further described in detail below with reference to specific embodiments.

Reference signs in the drawings of the specification include: 1—first penetrating spring; 2—second penetrating spring; 3—upper enclosure frame; 4—lower enclosure frame; 5—clip chip; 6—support spring; 10—coil spring; 20—penetrating spring; 30—contact portion; 40—wrapping blanket; 50—cotton felt; 60—plastic balancing net; and 70—clamp ring.

Figure 4:
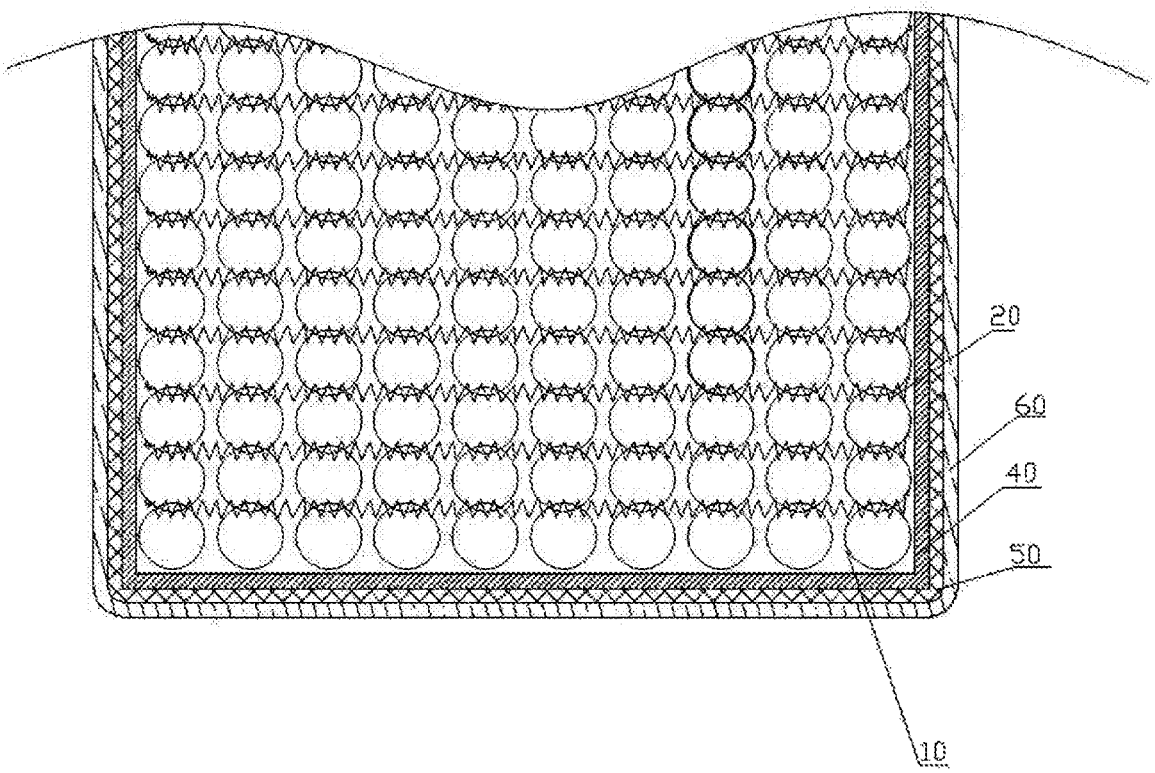
FIG. 4 is a schematic structural diagram of a foldable tension spring mattress according to an embodiment of the present invention.
Figure 5:
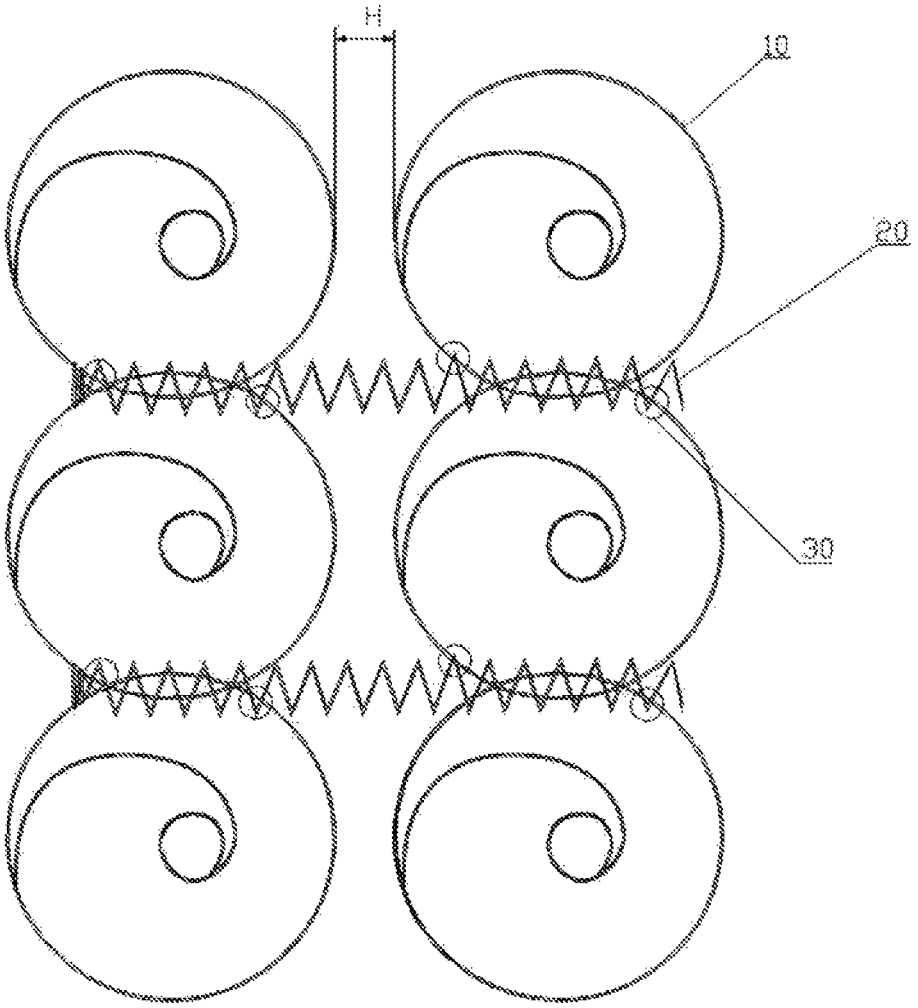
FIG. 5 is a schematic top view of a manner of assembling springs according to the present invention.

Embodiments are basically as shown in FIG. 4 and FIG. 5, where a foldable tension spring mattress includes a spring net and a wrapping blanket 40 wrapping the spring net.

In the spring net per square meter, 334 coil springs 10 and a plurality of penetrating springs 20 for connecting the coil springs 10 in series are used; the coil springs 10 are arranged in a rectangular array on the same horizontal plane; a distance H reserved between every two adjacent columns of the coil springs is 11 mm; and supporting rings of the coil springs 10 in adjacent rows are mutually abutted or crossed. The right end of the penetrating spring 20 penetrates through the coil springs 10 in a first row, a second row, . . . , an N-th row in sequence from left to right, and one penetrating spring 20 penetrates through the coil springs 10 in two rows. Therefore, the left end of the penetrating spring 20 penetrates into the first coil spring 10 in the first row at first and then out from the second coil spring 10 in the second row. A contact portion 30 where the first coil spring 10 in the first row is in contact with the penetrating spring 20 is located at the left side of the coil spring 10; a contact portion 30 where the second coil spring 10 in the second row is in contact with the penetrating spring 20 is located at the right side of the coil spring 10; and both of the contact portions 30 are located at two sides of the penetrating spring 20, so that the contact portions 30 where the coil springs 10 are in contact with the penetrating spring 20 are located at two sides of the penetrating spring 20, thereby preventing the coil springs 10 from being dislocated when the penetrating spring 20 or the coil springs 10 undergo the pulling force.

The left end of the penetrating spring 20 is wound on the left-most coil spring 10, and the right end of the penetrating spring 20 is wound on the right-most coil spring 10, so that the penetrating spring 20 and the coil springs 10 remain relatively stationary.

Each of the coil springs 10 has a free height of 156 mm, with upper and lower ends having a diameter of 52 mm, the middle recess having a diameter of 42 mm, and a steel wire having a diameter of 1.75 mm; the number of coils of each of the coil springs 10 is not less than 6; and a steel wire of each of the penetrating springs 20 has a diameter of 1.4 mm, and each of the penetrating springs 20 has a coil diameter of 8.1 mm, and a coil pitch of 11 mm. The penetrating springs 20 are matched with the coil springs 10 in respective parameters, and thus may effectively connect the coil springs 10 in series more stably.

Figure 6:
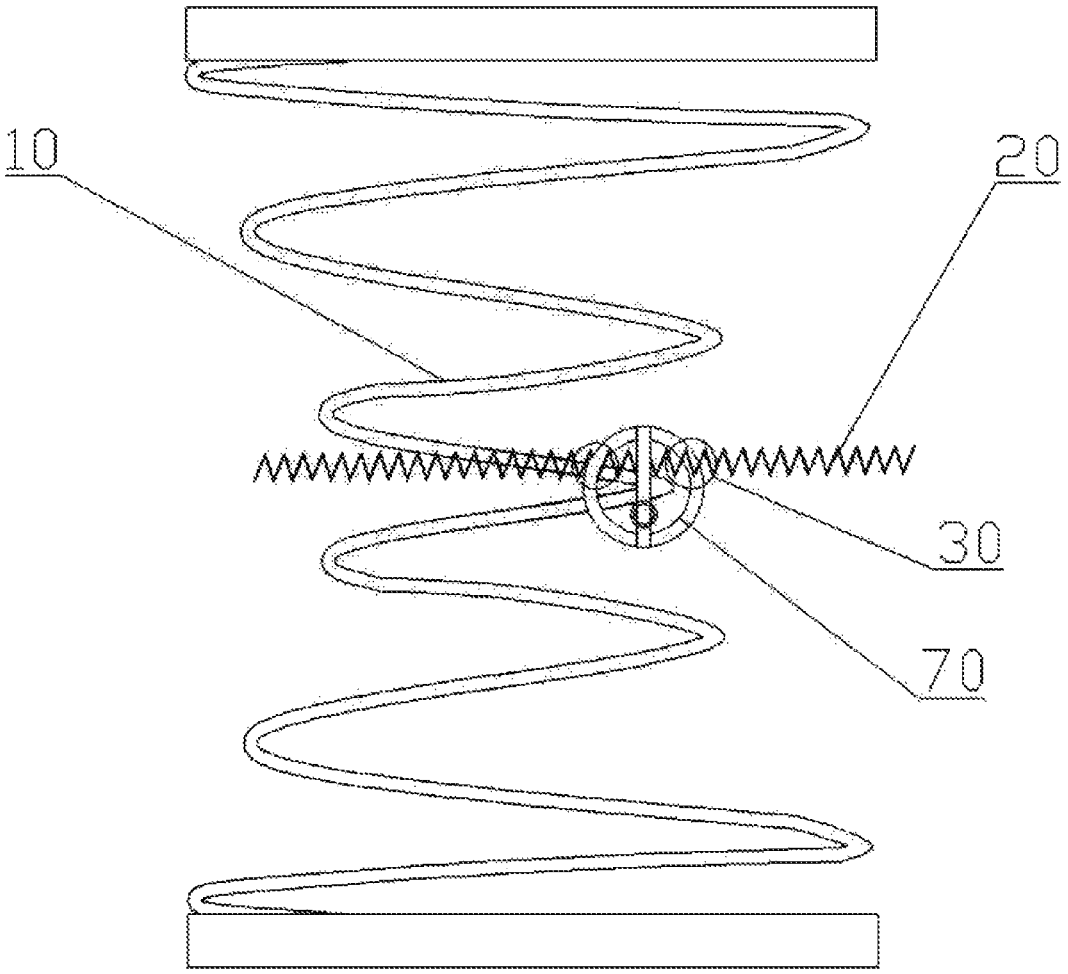
FIG. 6 is a schematic diagram of a middle recess in a coil spring in FIG. 4.

As shown in FIG. 6, a middle recess of each of the coil springs 10 is provided with a coiling-spring clamp ring for clamping the penetrating spring 20, through welding. Each of the coiling-spring clamp rings consists of two clamp rings 70 that are welded in cross. Each of the coiling-spring clamp rings is penetratively provided with two of the penetrating springs 20 which are crossed, with one penetrating spring 20 penetrating through one of the clamp rings 70 of the coiling-spring clamp ring, and being connected with the other clamp ring 70 of the coiling-spring clamp ring in series to form two contact portions 30. After the penetrating springs 20 penetrate into the respective coiling-spring clamp rings, the penetrating springs 20 at the middle recesses of the coil springs 10 are distributed in a net shape. When the coil springs 10 undergo a vertical downward pressure locally, the coil springs 10 are pressed down locally at first and simultaneously, convert the vertical pressure into a pulling force acting on the penetrating springs 20, allowing all the coil springs 10 connected in series on the penetrating springs 20 to undergo the pulling force, so that the vertical pressure may be effectively dispersed to all the coil springs 10 in the spring net to further allow all the coil springs 10 to undergo the force uniformly, thereby preventing the coil springs 10 from local plastic deformation and preventing the penetrating springs 20 and the whole spring net from being arched and sunken.

The surface of the spring net is wrapped with a plastic balancing net 60. The outer surface of the plastic balancing net 60 is wrapped with the wrapping blanket 40. The outer surface of the wrapping blanket 40 is wrapped with cotton felt 50. The wrapping blanket 40 is a chemical-fiber blanket or a woolen blanket, and the gram weight of either the chemical-fiber blanket or the woolen blanket is 580 g. The peripheries of the plastic balancing net 60, the wrapping blanket 40, and the cotton felt 50 are all fixedly connected to the coil springs 10 at the periphery of the spring net by pneumatic gun nails. Two ends of the pneumatic gun nail penetrate through the plastic balancing net 60, the wrapping blanket 40, the cotton felt 50 and the ends of the coil springs in sequence, and then, penetrate out from the other sides of the plastic balancing net 60, the wrapping blanket 40, and the cotton felt 50. Then, the two ends of the pneumatic gun nail are bent at the surface of the cotton felt 50 to facilitate the fixation of the plastic balancing net 60, the wrapping blanket 40 and the cotton felt 50 to the spring net. Meanwhile, both the cotton felt 50 and the wrapping blanket 40 may bring better softness and comfort to a human body.

In this embodiment, when a user lies on the mattress, the body weight directly acts on the cotton felt 50 and the plastic balancing net 60. Then a vertical pressure is directly transmitted to the wrapping blanket 40. Part of the vertical downward pressure acts on the coil springs 10 to press the coil springs 10 downward locally, and the other part of the vertical downward pressure is converted into a tension by the wrapping blanket 40. The tension is uniformly dispersed on the periphery of the wrapping blanket 40 to form a uniform pulling force acting on the periphery of the spring net. The coil springs 10 at the periphery the spring net first undergo the pulling force and then transmit the pulling force to the penetrating springs 20, thereby pulling the coil springs 10 connected in series on the penetrating springs 20 to move. Here, for every two adjacent coil springs 10, connected in series by the penetrating springs 20, in the same column, one of the coil springs 10 has the contact portion 30 for penetrating-in, and the other has the contact portion 30 for penetrating-out, both of the contact portions 30 are at two sides of the penetrating spring 20 to allow the two coil springs 10 to squeeze each other, thereby preventing the coil springs 10 in different rows from dislocation and ensuring the stability of the overall structure of the spring mattress. Meanwhile, the pulling force is dispersed to a plurality of coil springs 10 and penetrating springs 20, and when the penetrating springs 20 and the coil springs 10 undergo the pulling force, the pulling force is transmitted to the coil springs 10 connected in series on the penetrating springs 20, thereby alleviating the plastic deformation of the individual coil springs 10 and the individual penetrating springs 20.

At the same time, the vertical pressure acts on the coil springs 10; and the coil springs 10 are pressed down and simultaneously, pull the penetrating springs 20 connected with the clamp rings 70 in series, thereby converting the vertical pressure into the pulling force acting on the penetrating springs 20. Here, the penetrating springs 20 pull all the coil springs 10 connected with the penetrating springs 20 through the clamp rings to evenly transmit the pulling force to all the coil springs 10, thereby further dispersing the vertical pressure to each of the coil springs 10 and further keeping optimal elasticity for the spring mattress.

From tests performed on the spring mattress above, it can be known that when the spring net undergoes a pressure of 1000 kg per square meter, the spring net sinks by a height of 45 mm; and when the pressure is increased continuously, the wrapping blanket 40 will generate a tension to disperse the vertical pressure into a pulling force acting on the periphery of the spring net. The higher the pressure is, the more the pulling force converted from the tension is. The tension allows forces generated from disruptive strikes such as violent stamping, jumping, and pressing occurring to the spring net to be dispersed to the periphery, so that the spring net undergoes the force uniformly. The wrapping blanket 40 protects the penetrating springs 20 and the whole spring net from arching and sinking, and provides protection for the whole spring net in place of the upper and lower enclosure frames. Moreover, when the wrapping blanket 40 undergoes larger force, the tension is greater; the restoring performance of the spring net is not compromised; the coil springs 10 and the penetrating springs 20 in the spring net are not prone to deformation and may bounce downwards by 18-30 mm to fit a body curve for keeping the balance of the human body, thereby protecting the human spine and increasing the comfort level for sleep. A human body shall excrete more than 200 milliliters of water every day, and about one third of the water excreted by the human body is absorbed by the wrapping blanket 40 and cotton felt 50 every day. When the entire spring mattress is stepped on, air in the spring net is caused to circulate to effectively improve the air permeability of the spring mattress. As a result, molds and bacteria may be prevented from growing in the spring mattress.

The description above merely provides the embodiments of the present invention, and the specific structure and/or characteristics and other common knowledge known in the solutions are not described in detail herein. It should be noted that a number of variations and improvements can be made by a person of ordinary skills in the art without departing from the structure provided by the present invention, and these shall be construed as falling within the protection scope of the present invention, and will not affect the implementation effect and the patent applicability of the present invention. The protection scope of the present invention shall be subject to the protection scope defined by the claims, and the specific embodiments and others stated in the specification may be used to interpret the claims.

The invention claimed is:

1. A foldable tension spring mattress, comprising a spring net, wherein the spring net comprises a plurality of coil springs and a plurality of penetrating springs for connecting the coil springs in series; the coil springs are arranged in a rectangular array on the same horizontal plane; a distance H is reserved between every two adjacent columns of the coil springs; supporting rings of the coil springs in adjacent rows are mutually abutted or crossed; the foldable tension spring mattress being characterized in that each of the penetrating springs has one end penetrating in from a row of the coil springs, and the other end penetrating out from an adjacent row of the coil springs, thereby forming contact portions where the penetrating springs penetrate in or out from the coil springs; each of the coil springs has a contact portion for penetrating-in and a contact portion for penetrating-out; a middle recess of each of the coil springs is provided with a coiling-spring clamp ring for clamping a contacting penetrating spring of the plurality of penetrating springs through welding; the coiling-spring clamp ring consists of two clamp rings that are welded in cross; each of the coiling-spring clamp rings is penetratively provided with two of the penetrating springs which are crossed, with one penetrating spring penetrating through one of the clamp rings of the coiling-spring clamp ring and being connected with the other clamp ring of the coiling-spring clamp ring in series to form two contact portions; and the foldable tension spring mattress further comprises a wrapping blanket wrapping the spring net, wherein a periphery of the spring net is fixedly connected to a periphery of the wrapping blanket, and the wrapping blanket is a woolen blanket or chemical-fiber blanket with a gram weight of 550-600 g.

2. The foldable tension spring mattress according to claim 1, wherein each of the coil springs has a free height of 156 mm, with upper and lower ends having a diameter of 52 mm, the middle recess having a diameter of 42 mm, and a steel wire having a diameter of 1.75 mm; the number of coils of each of the coil springs is not less than 6; and a steel wire of each of the penetrating springs has a diameter of 1.4 mm, and each of the penetrating springs has a coil diameter of 8.1 mm, and a coil pitch of 11 mm.

3. The foldable tension spring mattress according to claim 2, further comprising cotton felt and a plastic balancing net, wherein the plastic balancing net is in contact with the spring net; the wrapping blanket wraps the plastic balancing net; and the cotton felt wraps the wrapping blanket.

4. The foldable tension spring mattress according to claim 3, wherein two ends of the penetrating springs are fixedly wound on the coil springs respectively.

* * * * *